US007685745B2

(12) United States Patent
Kuhtz et al.

(10) Patent No.: US 7,685,745 B2
(45) Date of Patent: Mar. 30, 2010

(54) TRACTION MEMBER FOR SHOE

(75) Inventors: Gerald Kuhtz, Encinitas, CA (US); David Ortley, Encinitas, CA (US); Marco Aurelio Grott, San Marcos, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 784 days.

(21) Appl. No.: 11/517,768

(22) Filed: Sep. 8, 2006

(65) Prior Publication Data

US 2007/0062070 A1 Mar. 22, 2007

Related U.S. Application Data

(60) Provisional application No. 60/715,943, filed on Sep. 9, 2005.

(51) Int. Cl.
*A43B 5/00* (2006.01)

(52) U.S. Cl. ..... 36/67 R; 36/67 D; 36/134

(58) Field of Classification Search ..... 36/67 R, 36/67 D, 134; D2/962
See application file for complete search history.

(56) References Cited

U.S. PATENT DOCUMENTS

| | | | | |
|---|---|---|---|---|
| 4,723,366 | A | 2/1988 | Hagger | |
| 5,027,532 | A | 7/1991 | MacNeill et al. | |
| 5,033,211 | A | 7/1991 | Latraverse et al. | |
| 5,036,606 | A | 8/1991 | Erich et al. | |
| D333,719 | S | 3/1993 | Latraverse et al. | |
| 5,426,873 | A | 6/1995 | Savoie | |
| D375,192 | S * | 11/1996 | Bathum | D2/962 |

(Continued)

FOREIGN PATENT DOCUMENTS

| | | |
|---|---|---|
| WO | WO 97/25890 | 7/1997 |

OTHER PUBLICATIONS

Callaway Golf, Footwear Technology: Big Berta Spike, 1 page (downloaded from http://callawaygolf.com/en.Footwear.Technology.html on Nov. 2, 2006).

(Continued)

*Primary Examiner*—Marie Patterson
(74) *Attorney, Agent, or Firm*—Klarquist Sparkman, LLP

(57) ABSTRACT

A traction member, such as a shoe cleat, for a shoe is described. According to one exemplary embodiment, a cleat securable to the sole of a shoe can include a hub with an exposed surface facing away from a shoe sole when the cleat is secured to the shoe. The cleat can further include a first group of large traction elements and a second group of small traction elements. The first group of large traction elements can be circumferentially-spaced about a periphery of the hub and with each large traction element extending downward and radially outward away from the exposed surface of the hub. The second group of small traction elements can be spaced-apart on and extend downward away from the exposed surface of the hub. The large traction elements can terminate at respective foot portions extending downward away from the hub by a first distance and the small traction elements can terminate at respective foot portions extending downward away from the hub by a second distance less than the first distance. The foot portion of each large traction element can include a generally downward facing surface that is sloped in a circumferential direction relative to the hub.

2 Claims, 7 Drawing Sheets

U.S. PATENT DOCUMENTS

| | | | | | |
|---|---|---|---|---|---|
| D388,949 | S | | 1/1998 | Savoie | |
| D391,048 | S | | 2/1998 | Savoie | |
| 5,768,809 | A | | 6/1998 | Savoie | |
| D408,978 | S | | 5/1999 | Savoie | |
| D410,139 | S | | 5/1999 | Savoie | |
| D415,341 | S | * | 10/1999 | Niikura | D2/962 |
| 6,094,843 | A | | 8/2000 | Curley, Jr. | |
| D449,431 | S | * | 10/2001 | Savoie | D2/962 |
| D452,947 | S | * | 1/2002 | Terashima | D2/962 |
| D455,896 | S | * | 4/2002 | Peabody | D2/962 |
| D473,699 | S | * | 4/2003 | Savoie | D2/962 |
| 7,073,280 | B2 | | 7/2006 | Terashima | |
| 7,073,281 | B2 | * | 7/2006 | Terashima | 36/134 |
| 7,076,894 | B2 | * | 7/2006 | Santos et al. | 36/134 |
| 2002/0069559 | A1 | * | 6/2002 | Gee | 36/134 |
| 2003/0131502 | A1 | * | 7/2003 | Terashima | 36/127 |
| 2004/0040182 | A1 | * | 3/2004 | McMullin | 36/134 |

OTHER PUBLICATIONS

Champ Spikes, Golf Spikes: Champ Trac, 2 pp. (downloaded from http://www.champspikes.com/golf/spikes_soft_champ.htm on Sep. 1, 2005).

Champ Spikes, Golf Spikes: Scorpion Stinger, 2 pp. (downloaded from http://www.champspikes.com/golf/spikes_soft_stinger.htm on Sep. 1, 2005).

Champ Spikes, Golf Spikes: Scorpion, 2 pp. (downloaded from http://www.champspikes.com/golf/spikes_soft_scorpion. htm on Sep. 1, 2005).

Softspikes, Cleats & Accessories: Black Widow, 2 pp. (downloaded from http://www.sofspikes.com/cleats-bw.html on Aug. 12, 2005).

Softspikes, Cleats & Accessories: Pulsar, 2 pp. (downloaded from http://www.sofspikes.com/cleats.html on Aug. 12, 2005).

Softspikes, Cleats & Accessories: Shadow, 2 pp. (downloaded from http://www.sofspikes.com/cleat-shadow.html on Aug. 12, 2005.

Trisport Ltd., Dynamic FTS Cleat 1 page (Nov. 14, 2005).

Trisport Ltd., Eclipse Fast Twist Cleat, 3 pp. (downloaded from http://www.birdiegolf.com.au/index.php on Nov. 2, 2006).

Trisport Ltd., Gyre Trac FTS Cleat, 1 page (Nov. 14, 2005).

Trisport Ltd., Tornado FTS Cleat, 1 page (Nov. 14, 2005).

Trisport Ltd., Various Cleats, 2 pp. (downloaded from http://www.trisportgolf.com/fast_twist/custom.htm on Nov. 2, 2006).

Wheat Road Golf, Softspike XP, 2 pp. (downloaded from http://www.wheatroadgolf.com/softspikes/index.html on Aug. 12, 2005.

* cited by examiner

TRACTION MEMBER FOR SHOE

CROSS REFERENCE TO RELATED APPLICATION

This application claims the benefit of U.S. Provisional Patent Application No. 60/715,943, filed Sep. 9, 2005, which is hereby incorporated by reference.

FIELD

The present application is directed to traction members, and more particularly to traction members that are securable to the sole of a shoe.

BACKGROUND

The need for providing improved traction members for the soles of shoes on turf surfaces is well known, particularly in the field of sports such as football, baseball, soccer and golf. In some sports, particularly golf, the need for providing improved traction members, which include cleats, must be considered in combination with limiting the wear and tear on the playing turf that can be caused by the traction elements.

In recent years, there has been a change from using penetrating metal spikes for golf shoes to removable plastic cleats that are more turf-friendly and less harmful to clubhouse floor surfaces. However, several challenges have presented themselves in using such plastic cleats. One challenge is to design a cleat having suitable traction on turf surfaces while being suitably protected from wear and tear due to contact with hard surfaces such as asphalt or concrete. Another challenge is designing a cleat that provides sufficient traction on a variety of terrain types encountered on a golf course, such as greens, fairways, and tee boxes. Additionally, cleats often become clogged with debris such as grass blades. Such debris can inhibit the cleats' ability to provide traction.

Accordingly, there is a need for a cleat that minimizes damage to turf surfaces and wear to the cleat itself, yet provides suitable traction for the shoe on a variety of golf course terrain types. The cleat described in the present application fulfills this need and others.

SUMMARY

Disclosed below are representative embodiments that are not intended to be limiting in any way. Instead, the present disclosure is directed toward novel and nonobvious features, aspects, and equivalents of the embodiments of the traction members described below. The disclosed features and aspects of the embodiments can be used alone or in various novel and nonobvious combinations and sub-combinations with one another.

Briefly, and in general terms, the present application describes a traction member, e.g., a shoe cleat, with features that produce several advantages over prior shoe cleats. Such advantages may be achieved together or separately.

According to one aspect, a cleat securable to the sole of a shoe can include a hub with an exposed surface facing away from a shoe sole when the cleat is secured to the shoe. The cleat can further include a first group of large traction elements and a second group of small traction elements. The first group of large traction elements can be circumferentially-spaced about a periphery of the hub and with each large traction element extending downward and radially outward away from the exposed surface of the hub. The second group of small traction elements can be spaced-apart on and extend downward away from the exposed surface of the hub. The large traction elements can terminate at respective foot portions extending downward away from the hub by a first distance and the small traction elements can terminate at respective foot portions extending downward away from the hub by a second distance less than the first distance. The foot portion of each large traction element can include a generally downward facing surface that is sloped in a circumferential direction relative to the hub.

In some implementations, the small traction elements can be interspersed between the traction elements of the first group about the periphery of the hub.

Yet in other implementations, the small traction elements can be spaced-apart about an interior portion of the exposed surface of the hub inwardly spaced from the periphery of the hub. In specific implementations, each of the small traction elements can be radially aligned with a respective large traction element. In yet other specific implementations, the small traction elements can be arranged in a generally circular configuration.

In some implementations, the large traction elements can have a first shape and the small traction elements can have a second shape substantially different than the first shape. In specific implementations, a cross-sectional area of each foot portion of the large traction elements can be greater than the cross-sectional area of each foot portion of the small traction elements along the horizontal plane.

In some implementations, the large traction elements can be resiliently flexible and have a first range of flexibility, and the small traction elements can be resiliently flexible and have a second range of flexibility. The first range of flexibility can be greater than the second range of flexibility such that the large traction elements can resiliently deform under predetermined conditions to permit at least some of the small traction elements to primarily contact and engage a surface.

In specific implementations, the first group of large traction elements can include three large traction elements. In yet other specific implementations, the first group of large traction elements can include six large traction elements.

According to one aspect, a cleat securable to the sole of a shoe can include a hub that has a central axis and an exposed surface facing away from the shoe sole when the cleat is secured to the shoe. The cleat can further include at least one traction element that extends downward and radially outward away from the exposed surface of the hub. The at least one traction element can have an elongate cross-sectional shape taken along a plane parallel to the exposed surface of the hub and be curved about the central axis of the hub. The at least one traction element can also include a leading edge portion and a trailing edge portion with the leading edge portion having a first thickness and a first height and the trailing edge portion having a second thickness and a second height. The first thickness can be less than the second thickness and the first height can be less than the second height.

In some implementations, the at least one traction element can include an arm portion that extends from the hub and terminates in a foot portion. A downwardly facing surface of the arm portion can have a substantially curved convex shape. In specific implementations, the foot portion can include a raised element that has a plurality of circumferentially spaced protrusions defining transverse grooves between the protrusions.

In some implementations, the cross-section of the foot portion of the at least one traction element can be generally kidney or teardrop shaped. In yet some implementations, the at least one traction element can include a wear indicator.

In some implementations, the cleat can include a plurality of traction elements circumferentially spaced about a periphery of the hub. In some aspects, the plurality of traction elements can be oriented to extend from the leading edge portion to the trailing edge portion in one circumferential direction about the hub. In yet other aspects, at least one of the plurality of traction elements can extend from the leading edge portion to the trailing edge portion in one circumferential direction about the hub and at least another of the plurality of traction elements can extend from the trailing edge portion to the leading edge portion in the same circumferential direction about the hub.

In yet some implementations, the at least one traction element can be a first traction element. The cleat can further comprise at least a second traction element extending downward from the exposed surface of the hub. The second traction element can have a shape that is different than the shape of the first traction element and a height that is less than a height of the first traction element. In certain implementations, the second traction element can have a generally frusto-conical shape.

According to another aspect, a shoe can include a sole having a bottom surface in which a bore is defined and a cleat that comprises a fastener portion at least partially received within the hole and a traction portion. The traction portion can have (i) a hub with an exposed surface that faces generally away from the sole and (ii) a plurality of traction elements that extend from the hub and away from the sole. The plurality of traction elements can include a first set of traction elements that are circumferentially-spaced about a periphery of the hub and extend generally downward and outward from the hub. Each traction element of the first set of traction elements can have a generally elongate shape curved about a central axis of the hub, a first height and a foot portion that is sloped in a circumferential direction with respect to the hub. The cleat can also include a second set of traction elements extending generally downward from the hub with each traction element of the second set of traction elements having a second height less than the first height.

According to one aspect of the described features, a cleat securable to the sole of a shoe includes a hub with an exposed surface facing away from a shoe sole when the cleat is secured to the shoe. A group of circumferentially-spaced traction elements each extends away from the exposed surface of the hub to a substantially continuous foot distal from the hub. Regions between the traction elements are substantially free of sharp angles that collect debris during use.

According to another aspect, a cleat securable to the sole of a shoe includes a hub with an exposed surface facing away from a shoe sole when the cleat is secured to the shoe. A group of circumferentially-spaced traction elements extends away from the exposed surface of the hub, and regions between the traction elements are substantially free of texturing.

According to yet another aspect, a cleat securable to the sole of a shoe includes a hub with an exposed surface facing away from the shoe sole when the cleat is secured to the shoe. The cleat also includes a group of circumferentially-spaced traction elements extending away from the exposed surface of the hub. An orientation of one or more areas of each traction element of the group of traction elements promotes torque release when the cleat rotates on turf.

According to yet another aspect, a cleat securable to the sole of a shoe includes a hub having an exposed surface facing away from the shoe sole when the cleat is secured to the shoe. A plurality of traction elements extend away from the exposed surface of the hub. One or more of the traction elements includes an arm extending from the hub and terminating in a foot. The arm includes a first arm component comprised of a first material and a second arm component comprised of a second material that is different from the first material.

According to yet another aspect, a cleat securable to the sole of a shoe includes a hub with an exposed surface facing away from a shoe sole when the cleat is secured to the shoe. A group of circumferentially-spaced traction elements extends away from the exposed surface of the hub, and each of the traction elements has a substantially kidney-shaped cross section.

In yet another aspect, a shoe includes a sole defining a hole extending upwardly into the sole. The sole includes an annular downwardly-facing surface area around the hole and an inwardly-facing annular surface extending downwardly from a periphery of the downwardly-facing surface. A cleat includes a fastener at least partially within the hole, an upwardly-facing annular surface abutting the downwardly-facing annular surface of the sole, and a neck extending down from the annular surface, the neck fitting at least partially within the inwardly-facing annular surface of the sole.

The foregoing and additional features and advantages of the disclosed embodiments will become more apparent from the following detailed description, which proceeds with reference to the following drawings.

DETAILED DESCRIPTION

Figure 1:
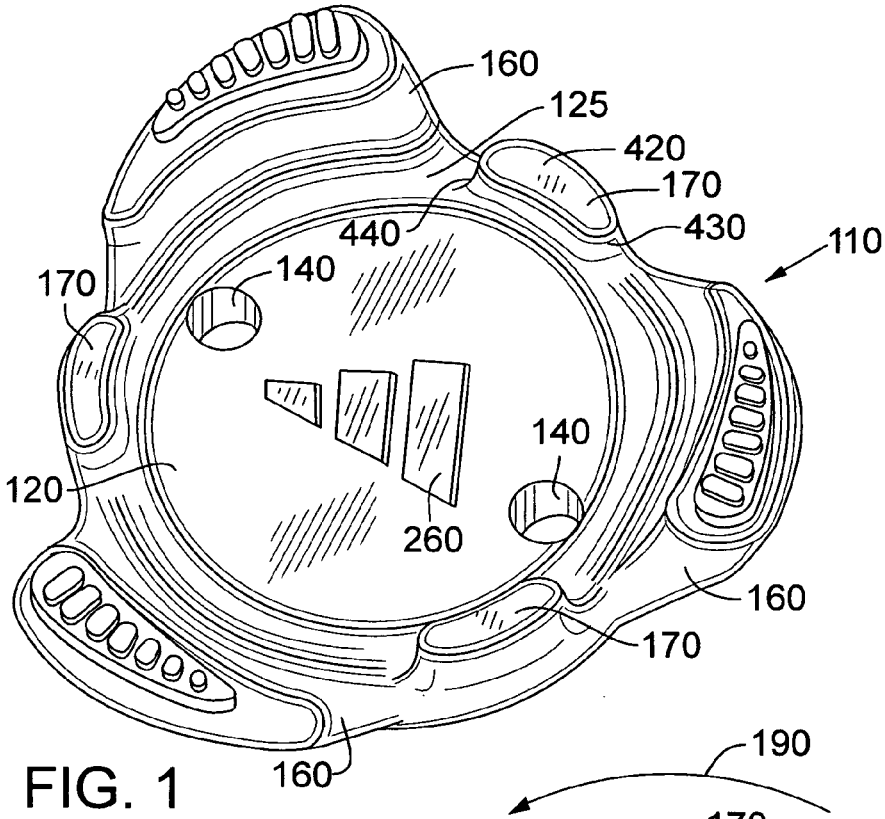
FIG. 1 is a bottom perspective view of a shoe cleat that is securable to the sole of a shoe according to one exemplary embodiment.

Disclosed below are representative embodiments that are not intended to be limiting in any way. Instead, the present disclosure is directed toward novel and nonobvious features, aspects and equivalents of the embodiments of the traction member described below. The disclosed features and aspects of the embodiments can be used alone or in various novel and nonobvious combinations and sub-combinations with one another.

Referring to FIGS. 1-4, there is shown a first embodiment of a traction member, in this case a golf shoe cleat 110 that has a generally disc-shaped hub 120 with a circular periphery 125, and a fastener 130 (see FIGS. 3-4) on the top side of the hub 120. In the illustrated embodiment, the fastener is of the type sold under the mark FAST TWIST by Trisport Ltd.

The hub 120 also defines tightening holes 140 (see FIGS. 1-2) that can receive mating protrusions from a tightening wrench for twisting the cleat onto and off of a shoe sole. Alternatively, the fastener can be any type of fastener suitable for securing the cleat 110 to a mating fastener on the sole of a shoe. For example, the fastener could be a standard large threaded plastic fastener or small threaded metal fastener.

Figure 5:
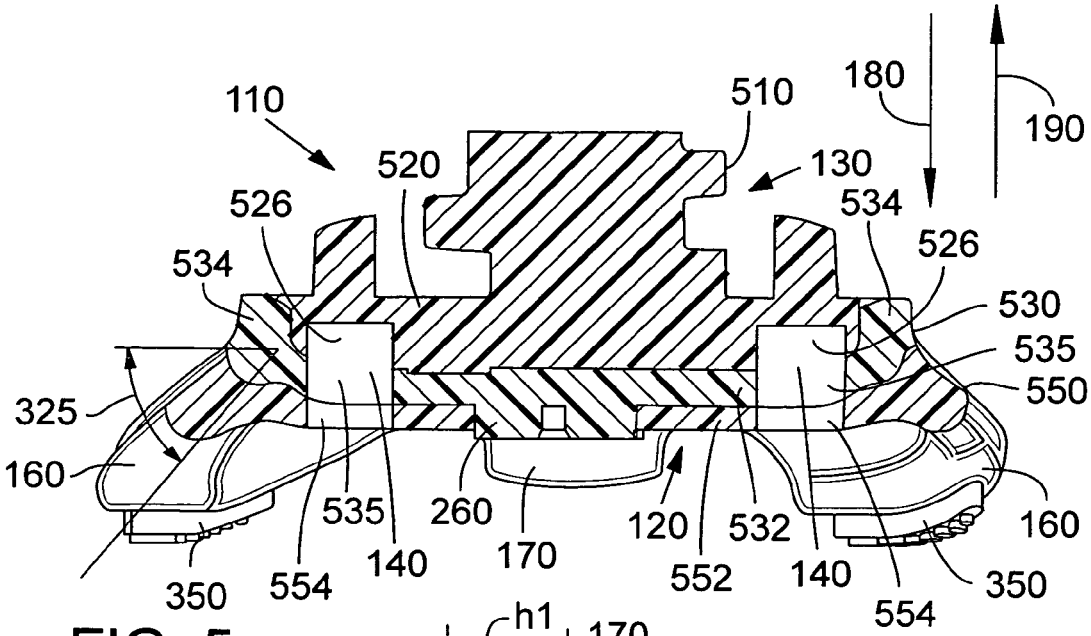
FIG. 5 is a sectional view taken along line 5-5 of FIG. 3.

The cleat 110 also includes three circumferentially-spaced large traction elements 160 extending generally downward (i.e., generally away from the sole of a shoe when the cleat 110 is attached, for example in the direction of arrow 180 in FIG. 5) and radially outward from the periphery 125 and away from the hub 120. In addition, three small traction elements 170 are, for example, circumferentially spaced about the periphery 125 and extend away from the hub 120 in the gaps between the large traction elements 160.

Different configurations and numbers of small and/or large traction elements may be used. For example, referring to FIGS. 10-13, there is shown a second embodiment of a traction member, in this case a golf shoe cleat 700 that has six circumferentially-spaced large traction elements 710 and six interiorly-positioned small traction elements 790. The golf shoe cleat 700 of the second embodiment shares many of the same or similar features and advantages of the golf shoe cleat 110 of the first embodiment, but also include several additional features and advantages. For the sake of simplicity, discussion of the features and advantages of the golf shoe cleat 700 of the second embodiment will be limited to different features and advantages in comparison to the golf shoe cleat 110 of the first embodiment. Accordingly, unless otherwise noted, reference to the features, and associated advantages and uses, of cleat 110 also apply to corresponding features of cleat 700.

In use, several cleats 110 are typically secured to the sole of a user's shoe. As the user steps down, pressure is applied to the cleat 110 and the large traction elements 160 are able to flex upwardly (i.e., generally toward the sole of a shoe when the cleat 110 is attached, for example in the direction of arrow 190 in FIG. 5). This flexing decreases both wear on the large traction elements 160 and damage to turf. It is also believed that the flexing may increase the traction in some situations, such as by temporarily trapping grass blades between the cleat 110 and the sole of the shoe. On hard surfaces such as many tee boxes where the large traction elements 160 may not provide sufficient traction, the large traction elements 160 flex upwardly, allowing the small traction elements 170 to engage such hard surfaces. Moreover, the flexing of the large traction elements 160 as well as the presence of the small traction elements 170 may increase traction in uneven terrain. Accordingly, it is believed that the combination of the large traction elements 160 and the small traction elements 170 can provide greater traction in a wider variety of terrains (such as tee boxes, roughs, greens, fairways, etc.) than cleats with only a single type of traction element. Additionally, the improved traction is achieved without any need for the user to adjust the cleats when encountering different types of terrain. However, many of the features described herein could be used with a cleat having only a single type of traction element.

Referring still to FIGS. 1-4 and describing the cleat 110 of the first embodiment with more particularity, the disc-shaped hub 120 defines a central axis 210 (see FIGS. 2-5) through which radial planes such as plane 230 (see FIG. 2) may pass. Of course, axis 210 and plane 230 are not features of the actual cleat 110, but are geometric features that can be used to describe the orientation and location of physical features of the cleat 110. The hub 120 can also be some shape other than circular (such as square, elliptical, etc.) and the hub may not be flat. A central axis and radial planes can still be defined for such other shapes, with the central axis being a line passing through the geometric center of the hub generally perpendicular to the sole of a shoe when the cleat is attached, and the radial planes being planes passing through the central axis. The periphery 125 of the hub 120 surrounds a substantially flat downwardly-facing (i.e., facing away from the sole of a shoe when the cleat 110 is secured to such shoe) exposed surface 250, and may include a logo 260 or other raised or indented features on or in the exposed surface 250. In some implementations, the exposed surface 250 is substantially flat, yet in other implementations, the exposed surface 250 can be rounded (see, e.g., exposed surface 730 of FIG. 13) or downwardly curved.

Traction Elements

Figure 2:
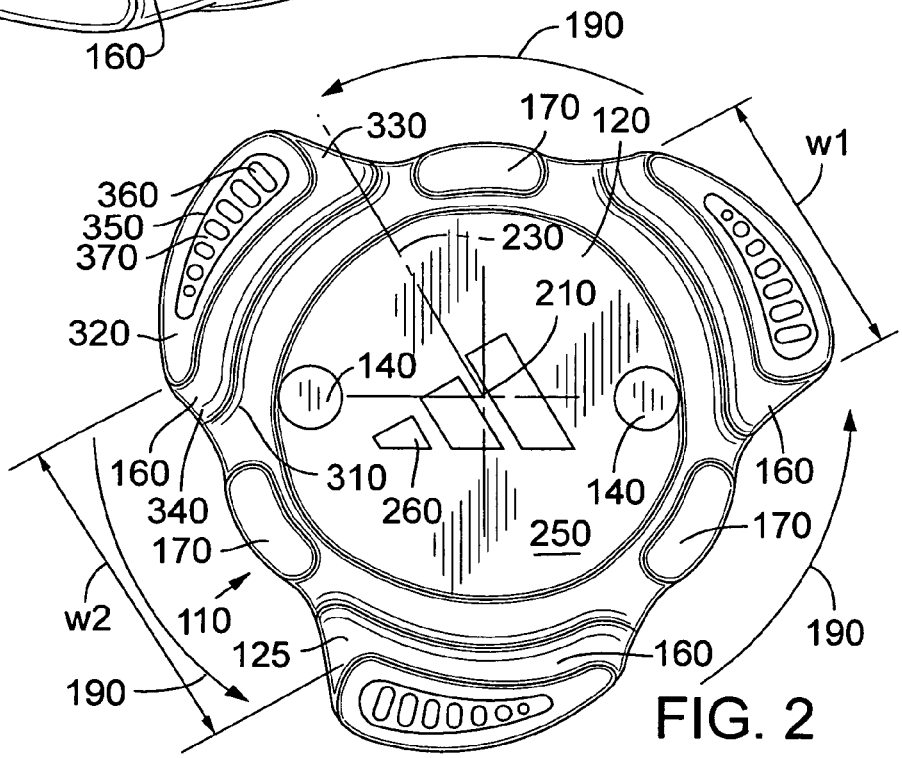
FIG. 2 is a bottom plan view of the shoe cleat of FIG. 1.
Figure 3:
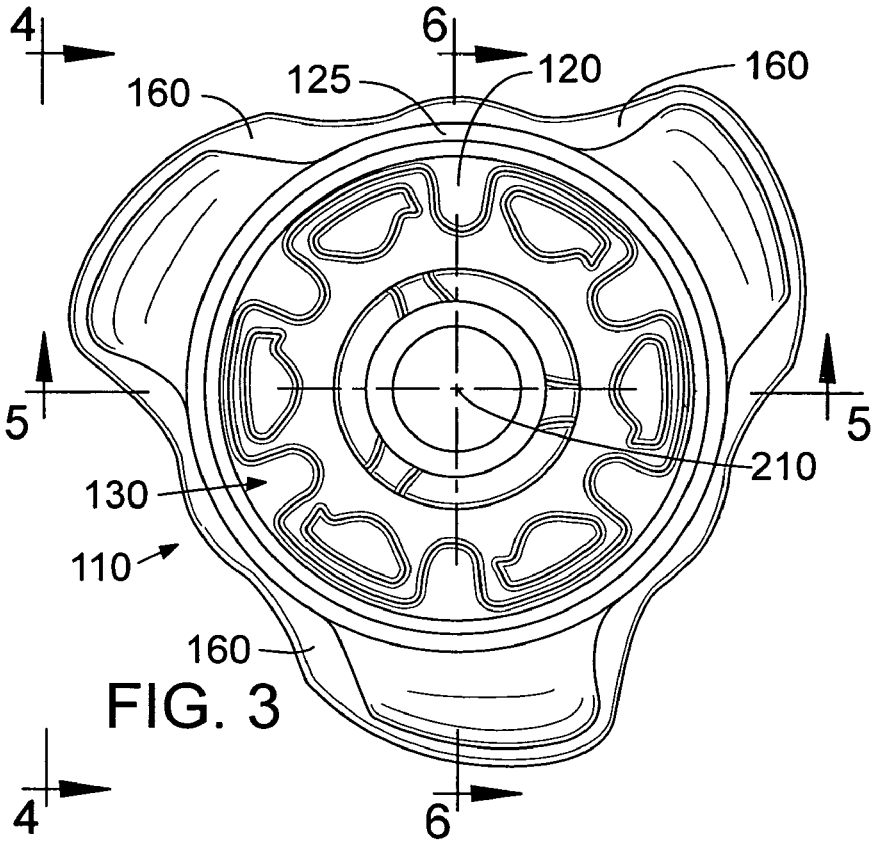
FIG. 3 is a top plan view of the shoe cleat of FIG. 1.
Figure 4:
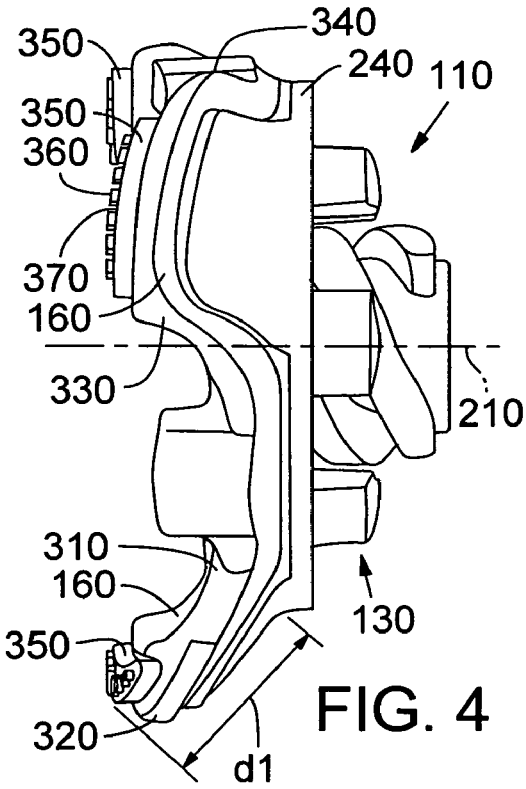
FIG. 4 is a side plan view taken along line 4-4 of FIG. 3.

With reference still to FIGS. 1-4, and particularly to FIG. 2, each large traction element 160 of the cleat 110 of the first embodiment includes a base 310 that is attached to the hub 120, and can be integrally formed with the hub 120. Each large traction element 160 extends generally downward and outward (i.e., generally away from the central axis 210 of the hub 120) from the base 310 toward a foot 320 located a distance d1 from the periphery 125 of the hub 120 (see FIG. 4). Distance d1 should be sufficient so that the large traction elements 160 can provide sufficient traction in long grass where shorter traction elements may not suffice. Moreover, the distance d1, the angle 325 (see FIG. 5) of the large traction elements 160, the thickness of the large traction elements 160, the overall shape of the large traction elements 160, and the material from which the large traction elements 160 are made should be such that the traction arms are sufficiently stiff to provide traction in softer terrains such as long grass, but sufficiently resilient so that the arms will deflect when they are used on hard surfaces.

As an example, in one implementation, the distance d1 may be about 6.5 mm, the angle 325 of the large traction elements 160 with respect to the hub 120 may be between about forty-five and fifty-five degrees, the thickness may be a minimum of about 2.2 mm, and the arms may be composed of polyurethane. In another implementation, such as with a cleat having six large traction elements, e.g., cleat 700, the large traction elements 710 extend a distance d3, or have a length, of about 7.5 mm from the periphery of the hub 720, an angle 722 of the large traction elements 710 with respect to the hub 720 may be between about 45 degrees and 55 degrees and the thickness of the large traction elements 710 may be a minimum of about 2 mm. In very specific implementations, the angle 722 of the large traction elements 710 is about 52 degrees.

Each large traction element 160 has a generally elongate kidney or teardrop shaped cross section in plan that is curved about the axis 210 and is generally thicker near a trailing edge 330 and generally thinner near a leading edge 340. It is believed that the leading edge 340 is more likely to lead when a cleat 110 is rotated while contacting terrain during use. The kidney shape is advantageous to provide traction in multiple directions and to provide rounded sides that resist build-up of grass and other debris. The two edges 330, 340 both have slight convex curves, although the trailing edge 330 has a larger angle with respect to the plane of the hub 120 when viewed from the side, looking toward the central axis 210.

If the angle of the trailing edge 330 with respect to the radial plane is sufficiently large, then if the cleat 110 is engaging terrain such as a golf green, and movement of the associated shoe causes the cleat to rotate, the resulting torsion can be released without significantly damaging the terrain. For example, the angle of the leading and trailing edges 330, 340 determined in this manner can be greater than about 110 degrees. For example, the edge may be greater than about 135 degrees. In one working cleat, the angle of the leading edge is about 135 degrees and the angle of the trailing edge is about 110 degrees.

In some embodiments, the foot portion 320 can be sloped in a circumferential direction. As perhaps best shown in FIG. 4, the foot 320 can be a substantially continuous surface that is downwardly sloped in a direction from the trailing edge 330 to the leading edge 340. In other words, the trailing edge 330 of the large traction elements 160 can have a first height h1 relative to the hub 120 and the leading edge 340 can have a second height h2 relative to the hub 120 that is smaller than the first height h1. In one specific exemplary implementation, the first height h1 can be about 3.6 mm and the second height h2 can be about 2.8 mm.

The sloped foot portions of the large traction elements can provide particular advantages over traction elements having flat or level foot portions. For example, sloping the foot portions allows the large traction elements to increasingly engage the ground as more pressure is applied to the cleats. In other words, the surface area of the foot portion in contact with the ground is at least partially dependent on the amount of pressure being applied to the cleat. In this manner, the portion of the foot portion in contact with the ground can be controlled to reduce the damage to turf surfaces generally caused by the large surface areas of conventional cleats contacting the ground while providing sufficient traction for the particular pressure being applied to the cleat.

As perhaps best shown in FIG. 2, the large traction elements 160 are similarly oriented when moving in a clockwise direction, as indicated by directional arrows 191 in FIG. 2, about the cleat 110. In other words, when moving in the clockwise direction, each large traction element is oriented in a leading edge to trailing edge orientation. For example, the leading edge 340 of each large traction element faces the trailing edge 330 of an adjacent large traction element, and the trailing edge of each large traction element faces the leading edge of an adjacent large traction element.

The foot 320 includes a raised area 350 that is narrower than the overall foot 320, but also has a generally kidney-shaped cross section in plan. The raised area 350 further includes circumferentially-spaced protrusions 360 along its length that define transverse grooves 370. The protrusions 360 and the raised area 350 can help to provide additional traction when the foot 320 engages a terrain. Moreover, the raised area 350 and the protrusions 360 can allow a user to see when the cleat 110 has become worn and needs to be replaced. For example, a user may wish to replace the cleat 110 when the protrusions 360 have worn off, or alternatively when the entire raised area has worn off from extended use.

The foot of each large traction element 170 is sufficiently large to prevent severe penetration that may damage terrain such as golf course greens. For example, the width w1 of each large traction element at the foot (i.e., the length of the foot) may be at least about 8 mm, such as from about 8 mm to about 12 mm. In one implementation the width w1 is about 11 mm. Moreover, the width w2 of the gaps between adjacent feet 320 of large traction elements 160 is sufficiently large so that grass and similar debris is not easily trapped and built up between the large traction elements 160. For example, each gap between feet 320 may have a width w2 that is at least about 12 mm, such as from about 12 mm to about 20 mm. In one implementation the width w2 is about 14 mm.

In specific implementations, the large traction elements 160 can be large enough such that the surface area of the exposed surface 250 of the hub 120 is less than about 2 times the surface area of each large traction element 160. In one implementation, the surface area of the exposed surface 250 of the hub 120 is about 200 $mm^2$ and the surface area of each large traction element 160 is about 120 $mm^2$ so that the surface area of the exposed surface 250 of the hub 120 is about 1.7 times the surface area of each large traction element.

Referring still to FIGS. 1-4, and particularly to FIG. 1, each of the small traction elements 170 includes a base 410 that is secured to and may be integrally formed (i.e., formed as a single piece) with the hub 120. More specifically, the small traction elements 170 are interspersed between the large traction elements 160 about the periphery of the hub 120. In the illustrated embodiments, the small traction elements 170 each extend generally down or transversely from the base 410 at the periphery 125 of the hub 120 a distance d2 to a foot 420 (see FIG. 6). Although in some embodiments, it is recognized that the small traction elements can extend downward and radially outward or inward with respect to the hub.

The distance d2 (or height of the small traction elements 170 when the elements extend transversely from the base) is smaller than the distance d1, the height h1 of the trailing edge 330, and in some embodiments, the height 42 of the leading edge 340 of the large traction elements 160. The small traction elements 170 and should be small enough so that the small traction elements 170 are sufficiently rigid to provide traction on hard surfaces such as typical tee boxes. The distance d1 may be from about twice the distance d2 to about six times the distance d2. In one implementation, the distance d1 is about three times the distance d2. For example, the distance d2 may be about 2 mm where the thickness of the small traction elements 170 is about 2 mm and the small traction elements are composed of polyurethane. Each small traction element 170 also includes a leading edge 430 and a trailing edge 440, both of which are approximately parallel to a radial plane that includes the respective edge 430, 440 and the axis 210 of the hub 120.

While the geometry of the particular traction elements has been described above with particularity, many other geometries and configurations can be used.

For example, with reference to FIGS. 10-13, in the second embodiment, the golf shoe cleat 700 includes the six large traction elements 710 circumferentially spaced about a periphery of a hub 720 such that a generally downward facing exposed surface 730 of the hub is between the large traction elements. The large traction elements 710 include the same general features as the large traction elements 160 of the cleat 110, however, a width w3 of the large traction elements 710 is shorter than the width w1 of the large traction elements 160, and the width w4 of the gaps between the large traction elements 710 are less than the width w2 of the gaps between the large traction elements 160 (see FIGS. 2 and 11).

Like the large traction elements 170 of cleat 110, a foot portion 780 of each large traction element 710 is sufficiently large to prevent severe penetration that may damage terrain such as golf course greens. For example, the width w3 of each large traction element at the foot (i.e., the length of the foot) may be at least about 5 mm, such as from about 5 mm to about 12 mm. In one specific implementation, the width w3 is about 7.4 mm. Moreover, the width w4 of the gaps between adjacent foot portions 780 of large traction elements 710 is sufficiently large so that grass and similar debris is not easily trapped and built up between the large traction elements. For example, each gap between feet 780 may have a width w4 that is at least about 4 mm, such as from about 4 mm to about 15 mm. In one specific implementation, the width w4 is about 5.4 mm.

Figure 11:
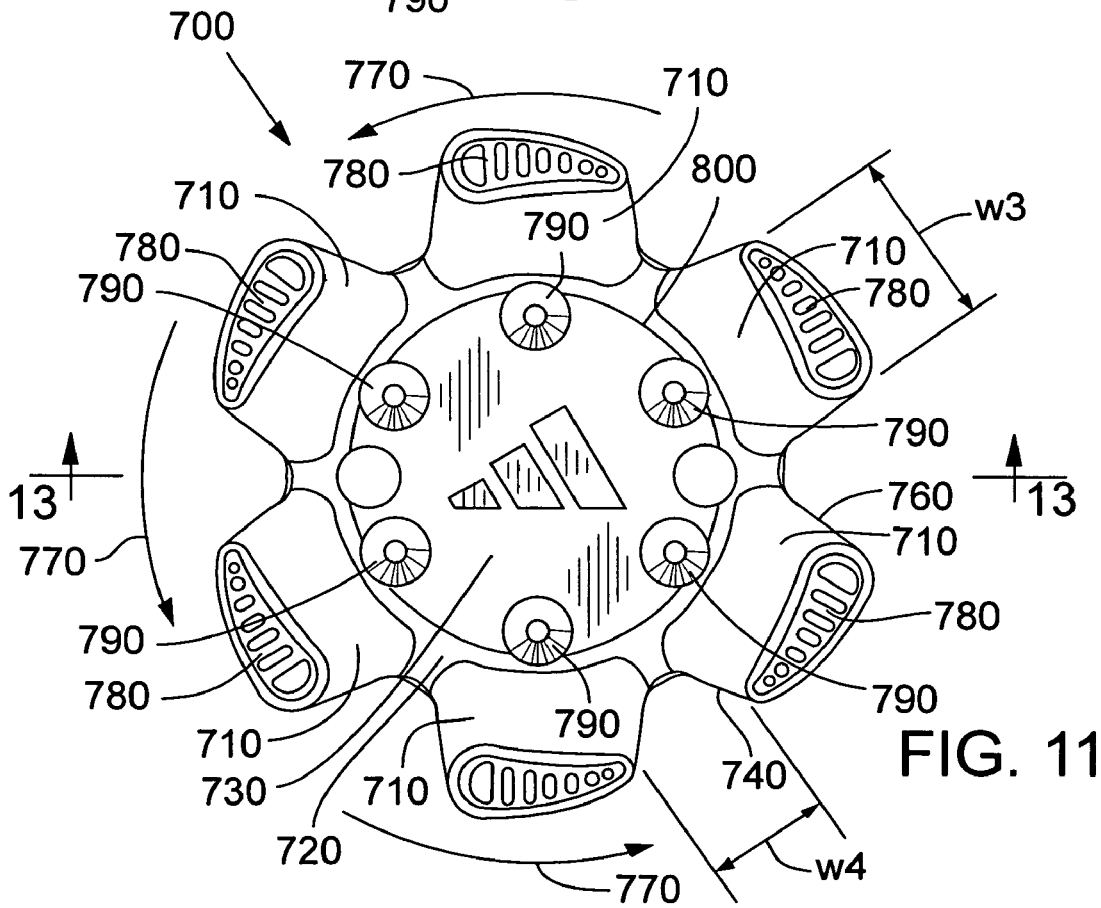
FIG. 11 is a bottom plan view of the shoe cleat of FIG. 10.
Figure 12:
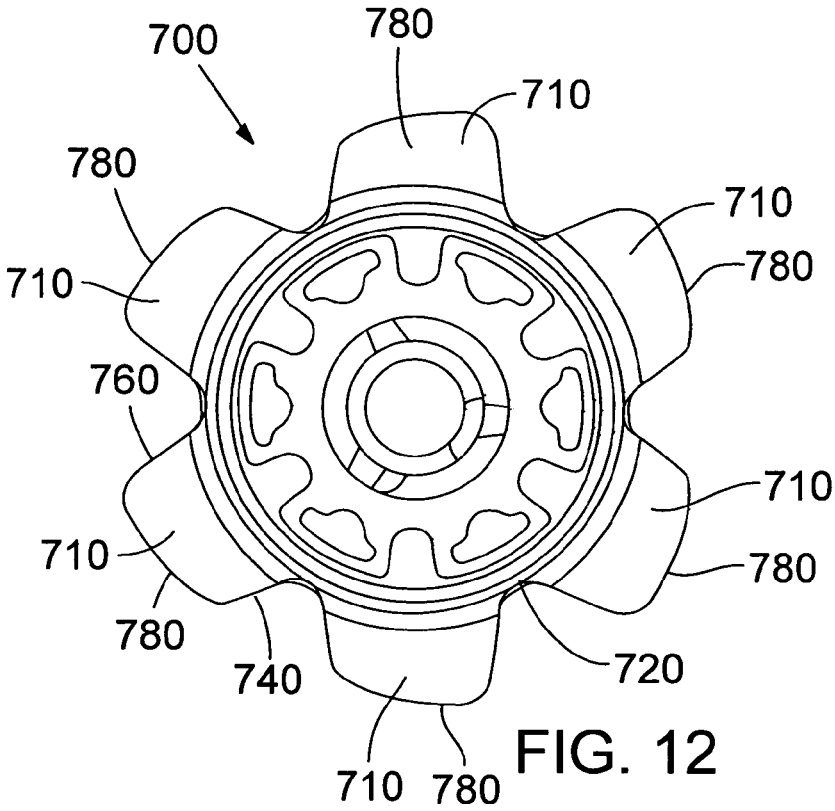
FIG. 12 is a top plan view of the shoe cleat of FIG. 10.

Additionally, as opposed to the exemplary embodiment of cleat 110 shown in FIGS. 1-4, each large traction element 710 is oriented such that a leading edge 740 and a trailing edge 760 of each large element is facing the leading edge and trailing edge of the adjacent traction elements (see, e.g., FIG. 11). In other words, the large traction elements 710 alternate between a first orientation, e.g., from leading edge 740 to trailing edge 760, and a second orientation, e.g., from trailing edge to leading edge, moving in a clockwise direction, such as indicated by directional arrow 770, or a counterclockwise direction opposite the clockwise direction, circumferentially about the periphery of the hub 720.

In some embodiments, a generally downward facing surface of the foot portion 780 of the large traction elements 710 is generally horizontal, while in other embodiments, such as illustrated, the foot portion can be sloped or angled with respect to horizontal. For example, with large traction elements having a continuously sloped foot portion, the leading edge portion 740 can have a first height h3 and the trailing edge portion 760 can have a second height h4 different that the first height. In more specific implementations, the height h3 of the leading edge portion 740 can be between about 2 mm and about 4 mm. In one specific implementation, the height h3 is about 2.8 mm. Moreover, in some implementations, the height h4 of the trailing edge portion 760 can be between about 3 mm and about 5 mm. In one specific implementation, the height h4 is about 3.8 mm.

Figure 13:
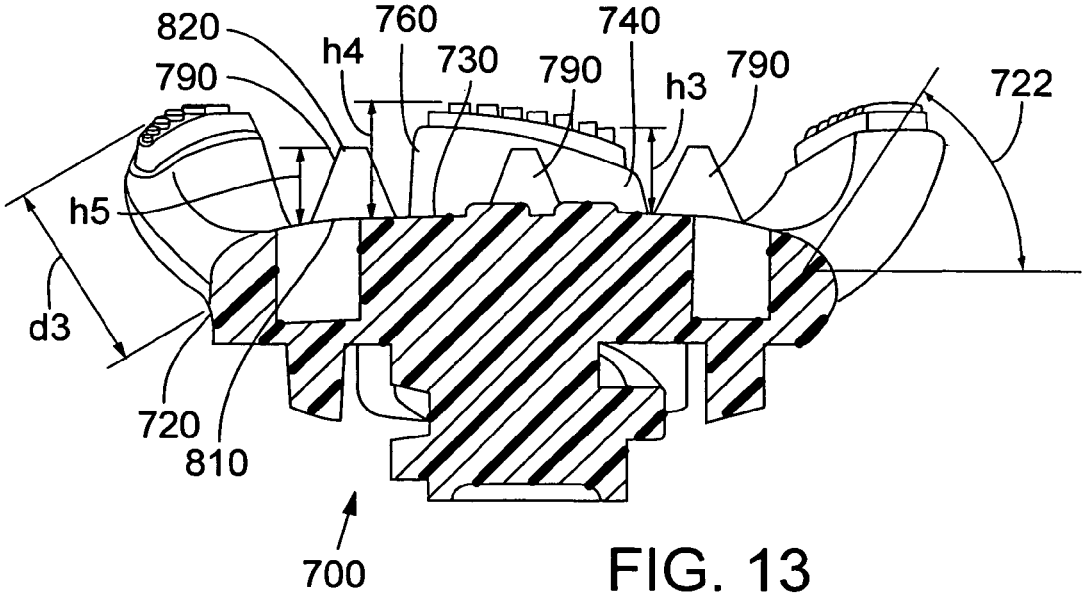
FIG. 13 is a section view taken along line 13-13 of FIG. 11.

In some embodiments, the slope of the downward facing surface of the foot portion 780 of the large traction elements can alternate between a generally upwardly directed slope and a generally downwardly directed slope from large traction element to large traction element circumferentially about the cleat (see FIG. 13). Alternating the orientation of the foot portion 780 of the large traction elements as shown in FIG. 13 provides particular advantageous. For example, it has been found that alternating the orientation of the foot portions 780 promotes improved traction during a golfer's swing. In the case of a right-handed golfer, the alternating orientation of the foot portions 780 provide improved traction as the golfer shifts weight to his back foot during a back swing motion, from the back foot to approximately both feet at the point of impact, and to his front foot during a follow-through motion. Additionally, in the event that a golfer's stance in on an uneven lie during a golf swing, the alternating orientation of the foot portions 780 provide improved traction irrespective of the contour of the ground.

Although the cleat 700 illustrated in FIGS. 10-13 has six large traction elements in an alternating pattern, it is recognized that in other embodiments, a cleat can have fewer or more than six large traction elements oriented in an alternating pattern or each having the same orientation.

Unlike the circumferentially spaced small traction elements 170 of the first embodiment, referring to FIGS. 10-13, the small traction elements 790 of the cleat 700 of the second embodiment extend downward from the exposed surface 730 the hub 720 at an interior portion 800 of the hub away from the periphery of the hub. The small traction elements 790 can be arranged on the interior portion 800 of the hub 720 in any of various configurations. For example, as shown, the small traction elements 790 are arranged in a spaced-apart and generally circular configuration. Moreover, in some implementations, one or more of the small traction elements 790 is radially aligned with a respective large traction element 710. In the illustrated implementation, the cleat 700 includes six small traction elements 790 each radially aligned with a respective one of the six large traction elements 710.

In the second embodiment, the small traction elements 790 each have a generally conical or frusto-conical shape. Other shapes, such as more columnar shapes or shapes similar to small traction elements 170, may also be suitable. As illustrated, the small traction elements 790 have a height h5, e.g., a distance generally transversely away from the exposed surface 730 of the hub 720, that is smaller than the height h3 of the trailing edge 760 of the large traction elements 710, and in some cases, the height h4 of the leading edge 740. The small traction elements 790 can extend from the exposed surface 730 of the hub 720 from a base 720 to an at least partially pointed foot portion 820.

The particular configuration of the small traction elements 790 can provide sufficient rigidity for traction on hard surfaces, including at least partial penetration into some hard surfaces for added traction. For example, in some specific implementations, the distance d3 may be from about twice the height h5 to about five times the height h5. In one implementation, the distance d3 is about 3 times the height h5. For example, the height h5 may be about 2.5 mm and the distance d3 may be about 7.5 mm.

Smooth Rounded Surfaces

The downwardly-facing surfaces of the cleat 110 and the cleat 700 are generally smooth and rounded.

Specifically, with reference to the cleat 110 as one example, the downwardly-facing surfaces near the bases 310, 410 of the traction elements 160, 170 are substantially free from sharp indentations or other sharp convex corners or substantial sharp convex angles. Sharp angles as used herein includes feature angles that are sufficiently small that they encourage the collection of debris such as grass blades during use. The cleat 110 thereby resists the collection of loose grass and other debris around the traction elements 160, 170. Such collected debris can inhibit the traction of a cleat, especially if it occurs near the traction elements. Indeed, it is common for golfers to use pressurized air, cleaning brushes, or other cleaning systems to remove debris that has accumulated in golf cleats.

Accordingly, the smooth, rounded surfaces having large radii of convex curvature on the illustrated cleat can improve the function of the cleat by eliminating sharp-angled features such as narrow grooves or crevices that are common between adjacent traction elements of prior cleats. For example, the surface regions near the bases 310, 410 of the traction elements 160, 170 are substantially free of discontinuities having angles that are less than about 150 degrees (although minor discontinuities that would not facilitate the build-up of debris such as grass may be present), and may be entirely free of convex discontinuities. Those surface regions may also be substantially free of concave discontinuities, and may even be substantially free of concave and convex discontinuities.

Moreover, in one implementation, the surface areas of the cleat where build-up of debris is likely to occur have an un-textured or polished finish. Such surface areas may include, for example, the areas near the bases 310 of the large traction elements 160 and the areas between the large traction elements 160. A polished finish need not be produced by a polishing process, but may be produced in other ways that produce a similarly smooth surface, such as using molds that are sufficiently smooth for an injection molding process.

Component Design

In certain implementations, the cleat 110 and the cleat 700 each include three components secured together. Alternatively, each cleat may include fewer or more components. For example, each cleat may be a single unitary member. As another example, each cleat may include two components, where a single component is used in place of the second and third components discussed below.

Figure 6:
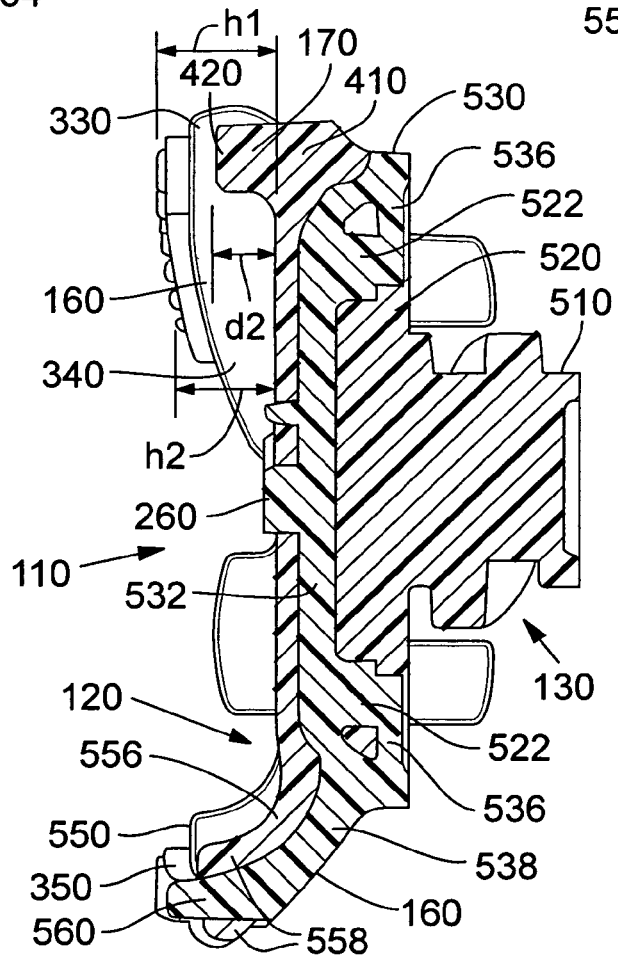
FIG. 6 is a sectional view taken along line 6-6 of FIG. 2.

Specifically, with reference to the cleat 110 as one example, in the illustrated embodiment, a first component 510 includes a disc-shaped first component hub 520 that forms the upper portion of the cleat hub 120 and the features of the fastener 130 discussed above extend up from the first component hub 520 (see FIGS. 5-6). The first component 510 defines a plurality of circumferentially-spaced holes 522 passing through the hub 520, as well as a pair of diametrically opposed holes 526 passing only partially through the hub 520 from below so that the holes 526 open down.

A second component 530 also includes a disc-shaped second component hub 532 that is below the first component hub 520. A raised central portion of the second component hub 532 forms the logo 260 discussed above, and an annular flange 534 extends up from the periphery of the hub 532. The annular flange 534 forms an upwardly extending neck of the cleat 110. Two holes 535 extend through the second component hub 532 and are aligned with the holes 526 that extend partially through the first component hub 520. A plurality of connecting features 536 extend from the hub 532 up through the holes 522 in the first component 510 and out to the upper edge of the flange 534. The flange 534 and the connecting features 536 help secure the second component 530 to the first component 510. Moreover, three circumferentially spaced arms 538 slope down and out from the periphery of the second component hub 532 to form a skeleton for the main arms of the large traction elements 160. The terminus of each arm 538 also forms the raised area 350 and protrusions 360 of each large traction element 160 discussed above.

A third component 550 includes a disc-shaped third component hub 552 that is generally below the second component hub 532, although the logo 260 of the second component 530 extends down through the third component hub 552. Thus, the first component hub 520, the second component hub 532, and the third component hub 552 form the overall hub 120 of the cleat 110. Two holes 554 that extend through the third component hub 552 are aligned with respective holes 526, 535 in the first and second component hubs 520, 532, respectively, to form the tightening holes 140 in the cleat hub 120, which are discussed above.

Three circumferentially-spaced arms of the third component 550 extend down from the periphery of the third component hub 552 to form the small traction elements 170 discussed above. The third component 550 also includes arms 556 interspersed between the small traction elements 170. The arms 556 extend out and down from the periphery of the third component hub 552 along the inner surfaces of the corresponding arms 538 of the second component 530, as well as around the leading and trailing edges of the arms 538. The terminus of each arm 556 forms a loop 558 that defines a hole 560 through which the corresponding second component arm 538 extends. Accordingly, the arms 538 of the second component 530 and the arms 556 of the third component 550 combine to form the large traction elements 160 discussed above. The connection between the arms 538, 556 also aids in securing the third component 550 to the second component 530.

Figure 7:
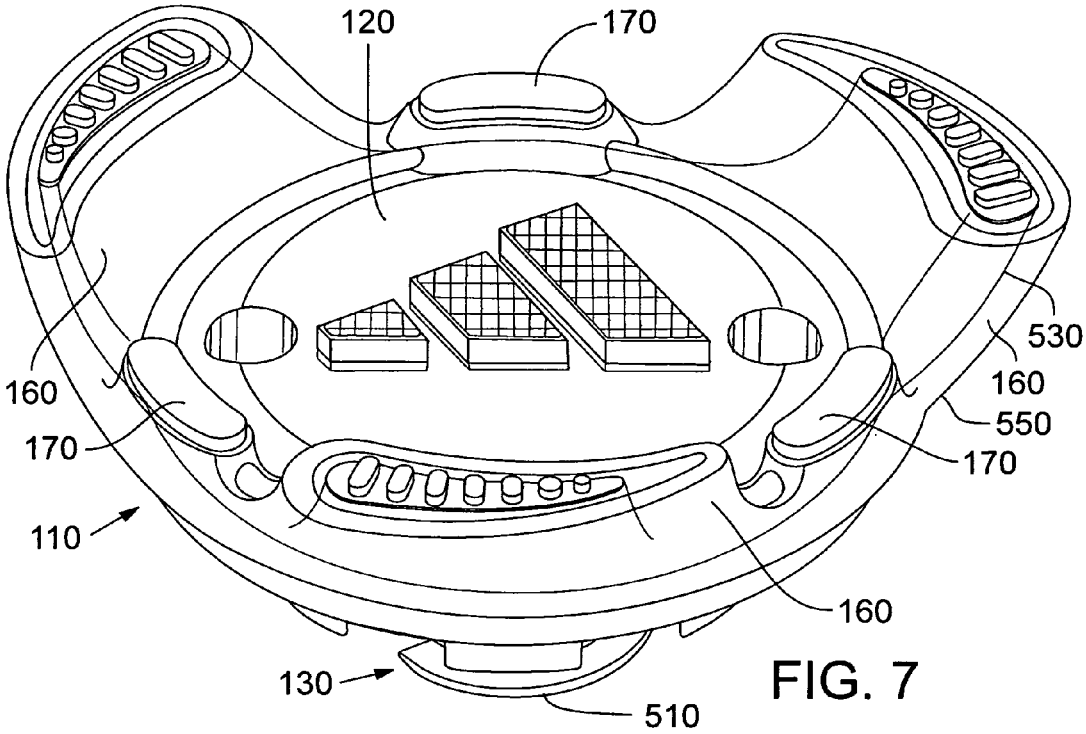
FIG. 7 is a bottom perspective view of a shoe cleat that is securable to the sole of a shoe, showing features that are visible through transparent material in light lines.
Figure 8:
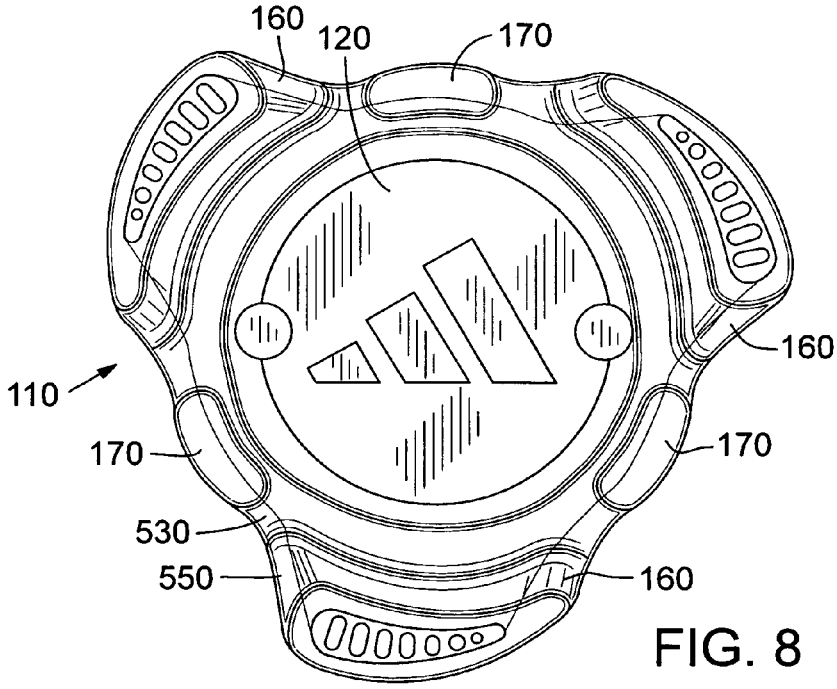
FIG. 8 is a bottom plan view of the shoe cleat of FIG. 7, showing features that are visible through transparent material in light lines.

Because the cleat 110 is composed of multiple components, different materials having different mechanical properties and colors can be used for each component to produce desired performance and aesthetic characteristics. For example, the first component can made of an opaque polyurethane or nylon-based material, the second component can be made of an opaque polyurethane or nylon-based material, and the third component can be made of a transparent polyurethane or nylon-based material. Such a cleat 110 is shown in FIGS. 7-8, which illustrate the features that can be seen through the transparent material with light lines. Reference numbers in FIGS. 7-8 are the same as for similar features in FIGS. 1-6, although the cleat shown in FIGS. 7-8 has a different type of fastener 130 from the fastener 130 of the cleat 110 illustrated in FIGS. 1-6. Many other kinds of materials can be used for one or more of the components, including metals, composites, and other types of polymers.

The cleat 110 can be made using standard injection molding techniques, where the first component 510 is the first shot, the second component 530 is the second shot, and the third component 550 is the third shot.

Shoe Outsole Interface

Figure 9:
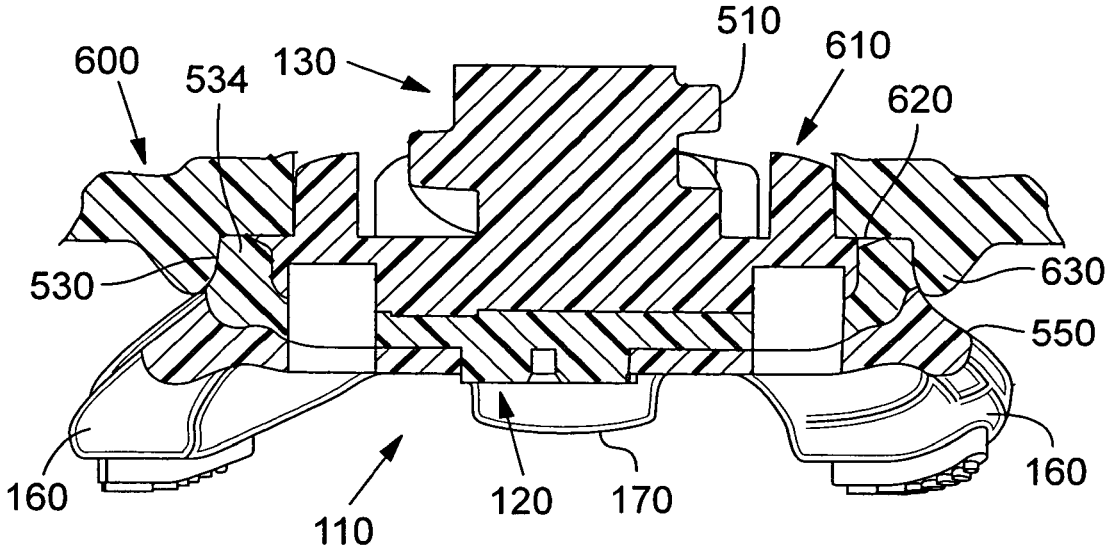
FIG. 9 is a sectional view similar to FIG. 5, but also including a cutaway portion of an outsole.
Figure 10:
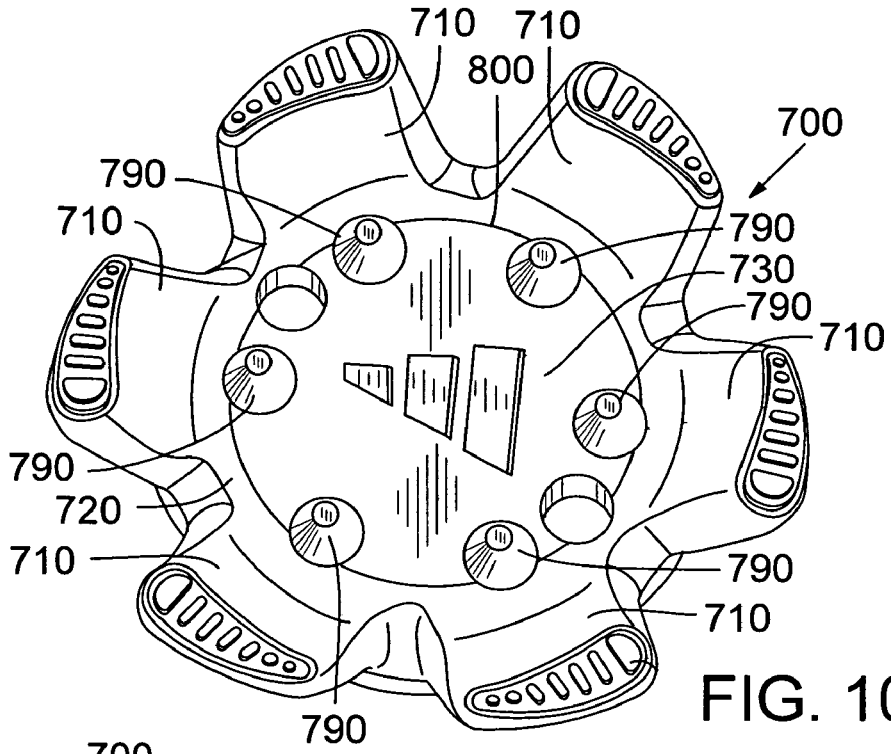
FIG. 10 is a bottom perspective view of a shoe cleat that is securable to the sole of a shoe according to another exemplary embodiment.

Referring now to FIG. 9, a shoe outsole 600 defines a hole 610 that receives the fastener 130 to secure the cleat 110 to the outsole 600. The hole 610 is surrounded by an annular shoulder 620, which is in turn surrounded by a downwardly-extending annular collar 630. When the cleat 110 is secured to the outsole 600, the downwardly-facing surface of the annular shoulder 620 of the outsole 600 abuts the upwardly-facing top surface of the flange 534 of the second component 530 of the cleat 110. Additionally, the collar 630 surrounds and abuts the neck of the cleat 110 formed by the flange 534. This fit between the cleat 110 and the outsole 600 guards against grass and other debris entering the fastener 130, where the debris could become trapped and build up during use.

In the same way, the cleat 700 can be secured to the outsole 600. In other words, the cleat 700 can include a fastener, similar to fastener 130, that can be received in the hole 610 of the shoe outsole 600.

Having illustrated and described the principles of the disclosed embodiments, it will be apparent to those skilled in the art that the embodiments can be modified in arrangement and detail without departing from such principles. In view of the many possible embodiments, it will be recognized that the described embodiments include only examples and should not be taken as a limitation on the scope of the invention. Rather, the invention is defined by the following claims. We therefore claim as the invention all possible embodiments and their equivalents that come within the scope of these claims.

We claim:

1. A cleat securable to the sole of a shoe, the cleat comprising:

a hub having a central axis and an exposed surface facing away from the shoe sole when the cleat is secured to the shoe;

at least one traction element extending downward and radially outward away from the exposed surface of the hub, wherein the at least one traction element has an elongate cross-sectional shape taken along a plane parallel to the exposed surface of the hub and curved about the central axis of the hub, and wherein the at least one traction element comprises a leading edge portion and a trailing edge portion, the leading edge portion having a first thickness and a first height, and the trailing edge portion having a second thickness and a second height, wherein the first thickness is less than the second thickness and the first height is less than the second height;

wherein the at least one traction element comprises a plurality of traction elements circumferentially spaced about a periphery of the hub; and wherein at least one of the plurality of traction elements extends from the leading edge portion to the trailing edge portion in one circumferential direction about the hub and at least another of the plurality of traction elements is oppositely oriented and extends from the trailing edge portion to the leading edge portion in the same circumferential direction about the hub.

2. A cleat securable to the sole of a shoe, the cleat comprising:

a hub having a central axis and an exposed surface facing away from the shoe sole when the cleat is secured to the shoe;

at least one traction element extending downward and radially outward away from the exposed surface of the hub, wherein the at least one traction element has an elongate cross-sectional shape taken along a plane parallel to the exposed surface of the hub and curved about the central axis of the hub, and wherein the at least one traction element comprises a leading edge portion and a trailing edge portion, the leading edge portion having a first thickness and a first height, and the trailing edge portion having a second thickness and a second height, wherein the first thickness is less than the second thickness and the first height is less than the second height;

wherein the at least one traction element is a first traction element, the cleat further comprising at least a second traction element extending downward from the exposed surface of the hub, wherein the second traction element has a shape that is different than the shape of the first traction element and a height that is less than a height of the first traction element; and wherein the second traction element has a generally frustoconical shape.

* * * * *